US008142263B2

(12) United States Patent
Li et al.

(10) Patent No.: US 8,142,263 B2
(45) Date of Patent: Mar. 27, 2012

(54) METHOD OF MANUFACTURING REVOLVING WHETSTONE AND REVOLVING WHETSTONE MANUFACTURED BY THE SAME

(75) Inventors: Xue Sheng Li, Osaka (JP); Takayuki Matsubara, Osaka (JP); Yoshikazu Yanagiura, Osaka (JP)

(73) Assignee: Fuji Grinding Wheel Mfg. Co. Ltd., Osaka (JP)

( * ) Notice: Subject to any disclaimer, the term of this patent is extended or adjusted under 35 U.S.C. 154(b) by 475 days.

(21) Appl. No.: 12/381,257

(22) Filed: Mar. 10, 2009

(65) Prior Publication Data

US 2010/0056032 A1 Mar. 4, 2010

(30) Foreign Application Priority Data

Aug. 27, 2008 (JP) ..... 2008-218407

(51) Int. Cl.
*B24B 27/08* (2006.01)

(52) U.S. Cl. ..... 451/358; 451/548

(58) Field of Classification Search ..... 451/358, 451/548, 544

See application file for complete search history.

(56) References Cited

U.S. PATENT DOCUMENTS

| | | | | | |
|---|---|---|---|---|---|
| 2,174,902 | A | * | 10/1939 | Stratford | 451/510 |
| 2,268,663 | A | * | 1/1942 | Kuzmick | 451/546 |
| 2,355,667 | A | * | 8/1944 | Ball et al. | 451/534 |
| 2,597,187 | A | * | 5/1952 | Roshong | 451/548 |
| 3,292,311 | A | * | 12/1966 | Hensley | 451/541 |
| 3,482,791 | A | * | 12/1969 | Alliegro | 241/296 |
| 4,541,205 | A | * | 9/1985 | Patrello | 451/342 |

FOREIGN PATENT DOCUMENTS

JP 5-51562 7/1993

* cited by examiner

*Primary Examiner* — Maurina Rachuba
(74) *Attorney, Agent, or Firm* — Fattibene and Fattibene LLC; Paul A. Fattibene

(57) ABSTRACT

In a method of manufacturing a revolving whetstone comprising a central portion in which a whetstone center hole into which a whetstone driving shaft of a grinder is inserted is arranged and a disk-shaped whetstone body that has an effective whetstone circular portion arranged in the circumferential outside of the central portion as one body, the wall thickness of the central portion is formed thinner than the wall thickness of the effective whetstone circular portion, and a whetstone material for the thinned wall thickness of the central portion is put on the wall thickness surface of the effective whetstone circular portion, and the wall thickness of the effective whetstone circular portion is formed thicker than the wall thickness of the central portion.

7 Claims, 6 Drawing Sheets

METHOD OF MANUFACTURING REVOLVING WHETSTONE AND REVOLVING WHETSTONE MANUFACTURED BY THE SAME

BACKGROUND OF THE INVENTION

1. Field of the Invention

The present invention relates to a method of manufacturing a revolving whetstone and a revolving whetstone manufactured by the same, in particular, it relates to a method of manufacturing revolving whetstones such as an offset type revolving whetstone for polishing and grinding (hereinafter, referred to as "polishing"), a flat type revolving whetstone for cutting, a disk revolving whetstone for polishing, a revolving whetstone with sandpaper for polishing and the like, and revolving whetstones manufactured by the same.

2. Description of the Related Art

Conventionally, the offset type revolving whetstone for polishing, the flat type revolving whetstone for cutting, the disk revolving whetstone for polishing, the revolving whetstone with sandpaper for polishing and the like have been known widely (for example, refer to Japanese Patent Application Laid-Open Publication No. H5-51562).

An example of the revolving whetstone known in the conventional art disclosed in Japanese Patent Application Laid-Open Publication No. H5-51562 and the like is shown in FIG. 8 and FIG. 9. In the figures, a revolving whetstone 51 is constituted of a disk-shaped whetstone body 52 and a reinforcing metal fitting 54 made of a metal attached to a whetstone center hole 53 of the whetstone body 52. In addition, the whetstone center hole 53 is an insertion hole for a whetstone driving shaft such as a hand grinder and the like, and, the reinforcing metal fitting 54 is arranged for reinforcement of the whetstone center hole 53.

The whetstone body 52 is made by mixing an abrasive grain (for example, bauxite) and binder resin, and molding and sintering the same, and has a central portion 52*a* in which the whetstone center hole 53 is arranged and an effective whetstone circular portion 52*b* that is arranged in the circumferential outside of the central portion 52*a* as one body, and in addition, a glass cloth reinforcing member 55 is inserted into the inside of the central portion 52*a* and the effective whetstone circular portion 52*b*. In addition, the reinforcing metal fitting 54 is made into one body with the whetstone body 52 at the time of molding the whetstone body 52.

Next, the case where the revolving whetstone 51 is attached to a hand grinder for use is explained. In the grinder to which the revolving whetstone 51 is attached, a whetstone driving shaft 62 protrudes from a grinder main body 61 as shown in FIG. 10, and a screw portion is formed in the end of the whetstone driving shaft 62, and the screw portion is so structured that a fastening nut 63 is screwed thereinto. In addition, a flange 62*a* and a whetstone engaging portion 62*b* are arranged at the portion near the root of the whetstone driving shaft 62.

When the revolving whetstone 51 is attached to the hand grinder, first, the whetstone engaging portion 62*b* that is arranged on the whetstone driving shaft 62 is inserted into the whetstone center hole 53, and one side of the revolving whetstone 51 is positioned to contact the flange 62*a*. Subsequently, the fastening nut 63 is screwed into the screw portion arranged in the end of the whetstone driving shaft 62 protruding from the other side of the revolving whetstone 51, and the revolving whetstone 51 is fastened together with the flange 62*a*. Thus, the revolving whetstone 51 is precisely centered and attached to the whetstone driving shaft 62.

The revolving whetstone 51 arranged to the grinder in this manner rotates together with the whetstone driving shaft 63, and is made to contact the surface of a workpiece to be polished 70 at the angle usually around 15 to 30 degrees and its polishing is carried out. In addition, the effective whetstone circular portion 52*b* is abraded as the polishing work goes on. When the abrasion progresses to the position shown by a mark Z in FIG. 9 (approximately 40%), it is judged that the revolving whetstone is out of its life time and is exchanged with a new revolving whetstone 51, and the old revolving whetstone 51 is disposed as an industrial waste. This exchange of the revolving whetstone 51 takes around 30 minutes in some work operations. Therefore, it has been desired to reduce the disposal amount of the industrial wastes, and, in addition, to expand the life time of the revolving whetstone 51, decrease the number of exchange times and improve the workability of the revolving whetstone.

SUMMARY OF THE INVENTION

In the conventional whetstone body 52 shown in FIG. 8 through FIG. 10, the wall thickness (also, referred to as "plate thickness", hereinafter same) of the central portion 52*a* and the wall thickness of the effective whetstone circular portion 52*b* used in the polishing work are formed in the same thickness. In other words, the wall thickness of the central portion 52*a* to be discharged as the industrial waste and the wall thickness of the effective whetstone circular portion 52*b* used in the polishing work are formed into the same thickness as one body, and the amount of the whetstone material which forms the central portion 52*a* discharged is large, which has led to problems in the disposal processing and problems of the costs. In particular, in late years, the amount of excavated bauxite used as whetstone material and the like is small, and the bauxite becomes expensive, and accordingly, it becomes important to reduce the disposal amount thereof. Furthermore, the life time of the whetstone body 52 is short, and it is necessary to exchange it with a new one frequently, which has been the problem of workability in the prior art.

Therefore, the technical problem to be solved in order to obtain a revolving whetstone that enables to expand the life time of the revolving whetstone, and reduce the amount of whetstone material to be disposed, and accordingly, the present invention is intended to solve the problem.

Means for Solving the Problems

The present invention has been made to achieve the object, and in the invention according to one embodiment, there is provided a method of manufacturing a revolving whetstone comprising a central portion in which a whetstone center hole into which a whetstone driving shaft of a grinder is inserted is arranged and a disk-shaped whetstone body that has an effective whetstone circular portion arranged in the circumferential outside of the central portion as one body, wherein the wall thickness of the central portion is formed thinner than the wall thickness of the effective whetstone circular portion, and a whetstone material for the thinned wall thickness of the central portion is put on the wall thickness surface of the effective whetstone circular portion, and the wall thickness of the effective whetstone circular portion is formed thicker than the wall thickness of the central portion.

According to this method of manufacturing, by use of the same amount as the amount of the conventional whetstone material used for forming a revolving whetstone, it is possible to form the thickness of the effective whetstone circular portion used actually by abrasion work thicker than the thickness of the whetstone circular portion of the conventional revolving whetstone, and obtain a revolving whetstone whose polishing effective amount is large.

Further, in the invention according to another embodiment, there is provided a revolving whetstone to be manufactured by a method of manufacturing a revolving whetstone that is equipped with a central portion in which a whetstone center hole into which a whetstone driving shaft of a grinder is inserted is arranged and a disk-shaped whetstone body that has an effective whetstone circular portion arranged in the circumferential outside of the central portion as one body, wherein the wall thickness of the effective whetstone circular portion is formed thicker than the wall thickness of the central portion.

According to this structure, even with the same amount of the whetstone material as the amount of the whetstone material used for forming the conventional revolving whetstone, it is possible to form the thickness of the effective whetstone circular portion used actually by abrasion work thicker than the thickness of the whetstone circular portion of the conventional revolving whetstone, and obtain an effective whetstone circular portion whose abrasion progress is small.

Furthermore, in the invention according to another embodiment, there is provided a revolving whetstone wherein a whetstone material for the thinned wall thickness of the central portion is put on the surface side of the opposite side of one side facing a workpiece to be polished of the effective whetstone circular portion, so that the thickness increases gradually from the rotation central side to the outer side.

According to this structure, it is possible to obtain a large area of the effective whetstone circular portion that contacts the surface of a workpiece to be polished at the angle usually around 15 to 30 degrees.

Moreover, in the invention according to another embodiment, there is provided a revolving whetstone wherein a whetstone material for the thinned wall thickness of the central portion is put on one surface side facing a workpiece to be polished of the effective whetstone circular portion, so that the thickness increases gradually from the rotation central side to the outer side.

According to this structure, it is possible to obtain a large area of the effective whetstone circular portion that contacts the surface of a workpiece to be polished at the angle usually around 15 to 30 degrees.

In the invention according to one embodiment, by use of the same amount as the amount of the conventional whetstone material used for forming a revolving whetstone, it is possible to obtain a revolving whetstone whose life time is longer than that of the conventional revolving whetstone, and accordingly, it is expected to reduce the number of exchange work operations, and improve workability and economic efficiency. In addition, because the amount of the whetstone material of the central portion to be disposed decreases, it is possible to reduce the amount of disposed wastes as much as possible.

In the invention according to another embodiment, it is possible to make the abrasion progress smaller than the conventional whetstone body, and, it is possible to form a revolving whetstone whose life time is longer than that of the conventional revolving whetstone. Thereby, it is expected to reduce the number of exchange work operations, and improve workability and economic efficiency. In addition, because the amount of the central portion to be disposed becomes small, it is possible to reduce the amount of disposed wastes.

In the invention according to another embodiment, because it is possible to obtain a large area of the effective whetstone circular portion to contact the surface of a workpiece to be polished, it is expected to improve the operation rate in addition to the effects of the invention according to other embodiments.

In the invention according to another embodiment, because it is possible to obtain a large area of the effective whetstone circular portion to contact the surface of a workpiece to be polished, it is expected to improve the operation rate in addition to the effects of the invention according to other embodiments.

BRIEF DESCRIPTION OF THE DRAWINGS

FIG. 6 is a view of experiment results of the polishing amounts of workpieces and the abrasion amounts of whetstones.

DESCRIPTION OF PREFERRED EMBODIMENT

The present invention has been made in order to expand the life time of a revolving whetstone, and reduce the amount of whetstone material to be disposed, and is realized by providing a method of manufacturing a revolving whetstone comprising a central portion in which a whetstone center hole into which a whetstone driving shaft of a grinder is inserted is arranged and a disk-shaped whetstone body that has an effective whetstone circular portion arranged in the circumferential outside of the central portion as one body, wherein the wall thickness of the central portion is formed thinner than the wall thickness of the effective whetstone circular portion, and a whetstone material for the thinned wall thickness of the central portion is put on the wall thickness surface of the effective whetstone circular portion, and the wall thickness of the effective whetstone circular portion is formed thicker than the wall thickness of the central portion, and a revolving whetstone manufactured by the method of manufacturing a revolving whetstone.

Figure 1:
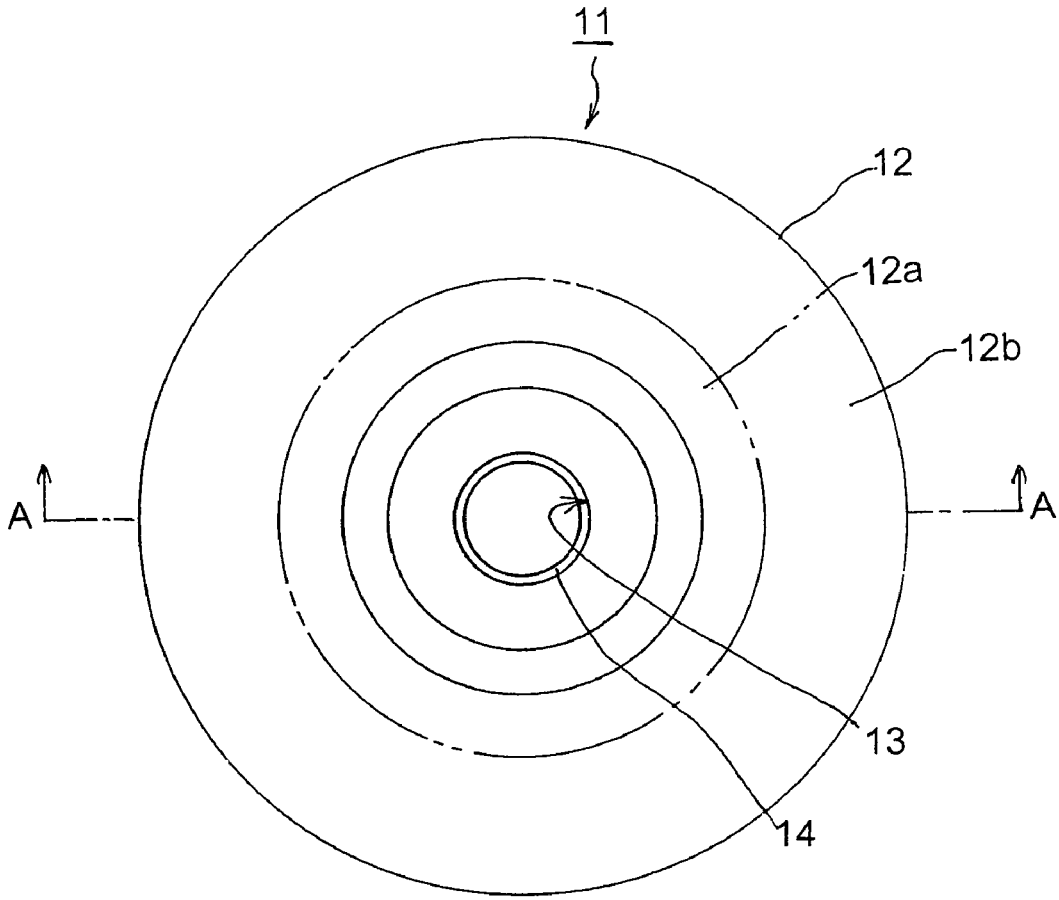
FIG. 1 is a top view of a revolving whetstone according to an embodiment to which the present invention is applied.
Figure 2:
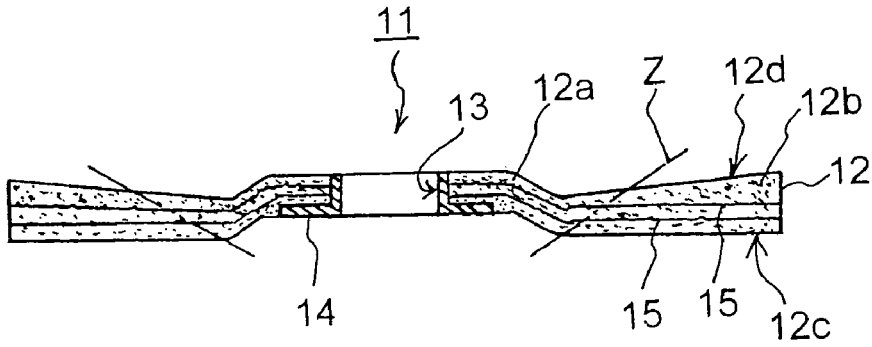
FIG. 2 is a cross sectional view taken along A-A line of FIG. 1.
Figure 3:
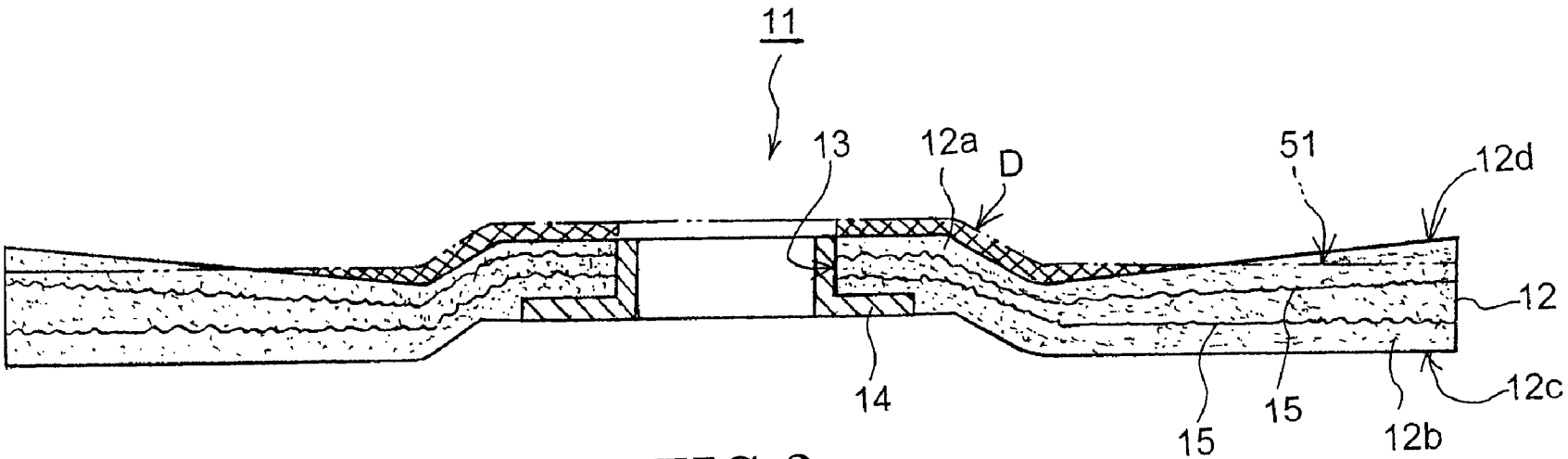
FIG. 3 is an enlarged cross sectional view of FIG. 2.

Hereinafter, a revolving whetstone of the present invention is explained with reference to a preferred embodiment. FIG. 1 through FIG. 3 show an embodiment of a revolving whetstone to which the present invention is applied, and, FIG. 1 is a top view of the revolving whetstone, FIG. 2 is a cross sectional view taken along A-A line of FIG. 1, and FIG. 3 is an enlarged cross sectional view of FIG. 2.

In FIG. 1 through FIG. 3, a revolving whetstone 11 is constituted of a disk-shaped whetstone body 12 and a reinforcing metal fitting 14 made of a metal attached to a whetstone center hole 13 of the whetstone body 12. In addition, the whetstone center hole 13 is a hole into which a whetstone driving shaft of a hand grinder or the like is inserted, and, the reinforcing metal fitting 14 is arranged for reinforcement of the whetstone center hole 13.

The whetstone body 12 is made by mixing an abrasive grain (for example, bauxite) and binder resin, and molding and sintering the same, and has a central portion 12*a* in which the whetstone center hole 13 is arranged and an effective whetstone circular portion 12*b* that is arranged in the circumferential outside of the central portion 12*a* as one body, and in addition, a glass cloth reinforcing member 15 is inserted into the inside of the central portion 12*a* and the effective whetstone circular portion 12*b*.

When the whetstone body 12 is formed, the wall thickness of the central portion 12*a* is made thin, and the wall thickness of the effective whetstone circular portion 12*b* is made thicker than the wall thickness of the central portion 12*a*. In this case, the surplus whetstone material generated by making thin the wall thickness of the central portion 12*a* is put on the wall thickness surface of the effective whetstone circular portion 12*b*, and thereby the wall thickness of the effective whetstone circular portion 12*b* is so formed as to become thicker than the wall thickness of central portion 12*a*.

Therefore, as shown in FIG. 3, when onto the revolving whetstone 11 according to the present embodiment, the conventional revolving whetstone 51 that is formed with the same amount of whetstone material as that of the revolving whetstone 11 is drawn and overlapped in a two-dot chain line, it is understood that the wall thickness of the effective whetstone circular portion 12*b* of the whetstone main body 12 in the present embodiment is thicker than the wall thickness of the effective whetstone circular portion of the whetstone main body 52 of the conventional structure. In other words, the portion shown by the X cross section in FIG. 3 is the portion that is made thinner in the whetstone body 12 of the present embodiment, and the surplus whetstone material generated by making the portion thinner is put on the surface 12*d* of the opposite side of one surface 12 facing a workpiece to be polished so that the thickness increases gradually from the rotation central side to the outer side.

Figure 4:
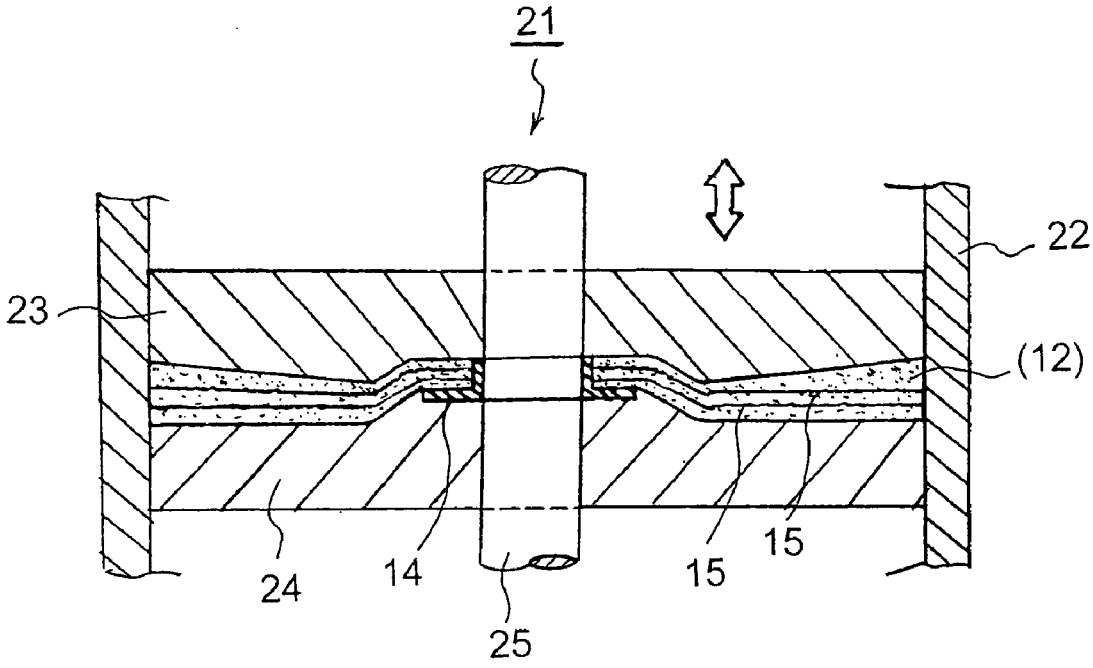
FIG. 4 is a cross sectional view schematically showing an example of a molding device for manufacturing a revolving whetstone according to an embodiment of the present invention.

FIG. 4 is a cross sectional view showing an example of a molding device for manufacturing the revolving whetstone 11 shown in FIG. 1 to FIG. 3. In the figures, a molding device 21 is equipped with a ring-shaped external circumferential mold 22, a top mold 23 and a bottom mold 24 arranged in the external circumferential mold 22, a bar-shaped core member 25 that keeps the top mold 23 and the bottom mold 24 at a specified position in the external circumferential mold 22 and expands in the vertical direction, and the like. In addition, one of the top mold 23 and the bottom mold 24 can move vertically to the other, and the movement thereof is guided by the bar-shaped core member 25.

At the time of molding, in the state where the bottom mold 24 and the top mold 23 are set away, the reinforcing metal fitting 14, two glass cloth reinforcing members 15, 15 are attached to the bar-shaped core member 25 between the bottom mold 24 and the top mold 23 respectively, and an abrasive grain is mixed, and binder resin (12) in its molten state is injected into the portion between the bottom mold 24 and the top mold 23. Thereafter, the bottom mold 24 and the top mold 23 are made to contact each other by pressure, and the binder resin (12) is solidified, then a one-body revolving whetstone 11 in which the reinforcing metal fitting 14 and the glass cloth reinforcing members 15, 15 are inserted in the binder resin (12) as shown in FIG. 1 to FIG. 3 is obtained.

Figure 5:
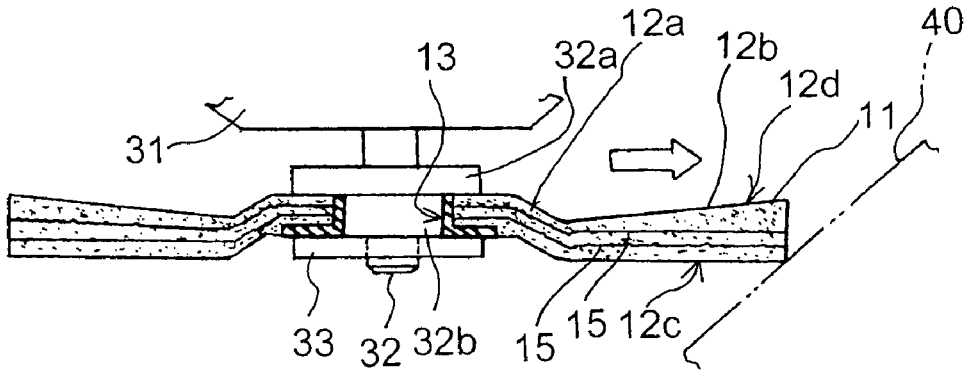
FIG. 5 is an explanatory figure of the use conditions of a revolving whetstone of the present invention.

Next, a case where the revolving whetstone 11 is attached to a hand grinder for use is explained. In the grinder to which the revolving whetstone 11 is attached, a whetstone driving shaft 32 protrudes from a grinder main body 31 as shown in FIG. 5. A screw is arranged at the end of the whetstone driving shaft 32, and a fastening nut 33 can be screwed into the end. In addition, a flange 32*a* and a whetstone engaging portion 32*b* are arranged at the portion near the root of the whetstone driving shaft 32.

When the revolving whetstone 11 is attached to the hand grinder, first, the whetstone center hole 13 is set to the whetstone engaging portion 32*b* arranged on the whetstone driving shaft 32, and one side 12*b* of the revolving whetstone 11 is positioned to contact the flange 32*a*. Subsequently, the fastening nut 33 is screwed into the screw portion arranged in the end of the whetstone driving shaft 32 protruding from the other side 12*c* of the revolving whetstone 11, and the revolving whetstone 11 is fastened together with the flange 32*a*. Thus, the revolving whetstone 11 is precisely centered and attached to the whetstone driving shaft 32.

The revolving whetstone 11 arranged to the grinder in this manner rotates together with the whetstone driving shaft 22, and is made to contact the surface of a workpiece to be polished 40 at the angle usually around 15 to 30 degrees and its polishing is carried out. In addition, the effective whetstone circular portion 12*b* is abraded as the polishing work goes on. When the abrasion progresses to the position shown by a mark Z in FIG. 2 and FIG. 3, it is judged that the revolving whetstone is out of its lire time and is exchanged with a new revolving whetstone 11, and the old revolving whetstone 11 is disposed as an industrial waste.

However, the effective whetstone circular portion 12*b* of the whetstone body 12 of the present embodiment is formed that the wall thickness thereof is thicker than the wall thickness of the effective whetstone circular portion of the conventional whetstone main body formed with the same amount of whetstone material as mentioned above, and the thickness increases gradually from the rotation central side to the outer side, and accordingly, it is possible to obtain a large area of the effective whetstone circular portion 12*b* that contacts the surface to be polished of a workpiece 40 at the angle usually around 15 to 30 degrees. Thereby, the operation rate of the effective whetstone circular portion 12*b* is improved, and the time from polishing until it is necessary to exchange whetstones becomes longer, and the amount of whetstone material to be disposed decreases.

FIG. 6 shows an example of the experiment results showing the polishing amounts and the abrasion amounts of the revolving whetstone 11 of the present invention and the conventional revolving whetstone. This experiment shows the polishing amount of the workpiece and the abrasion amount of the whetstone obtained when the whetstone diameter of the revolving whetstone was set 100 mm, and the rotation speed was set 12000 times/min, and the respective revolving whetstones were continuously pushed onto workpieces for five times every five minutes and the polishing work was carried out, and as for the effective use amount, the external circumference of the whetstones were abraded 40% or below.

Figure 6A:
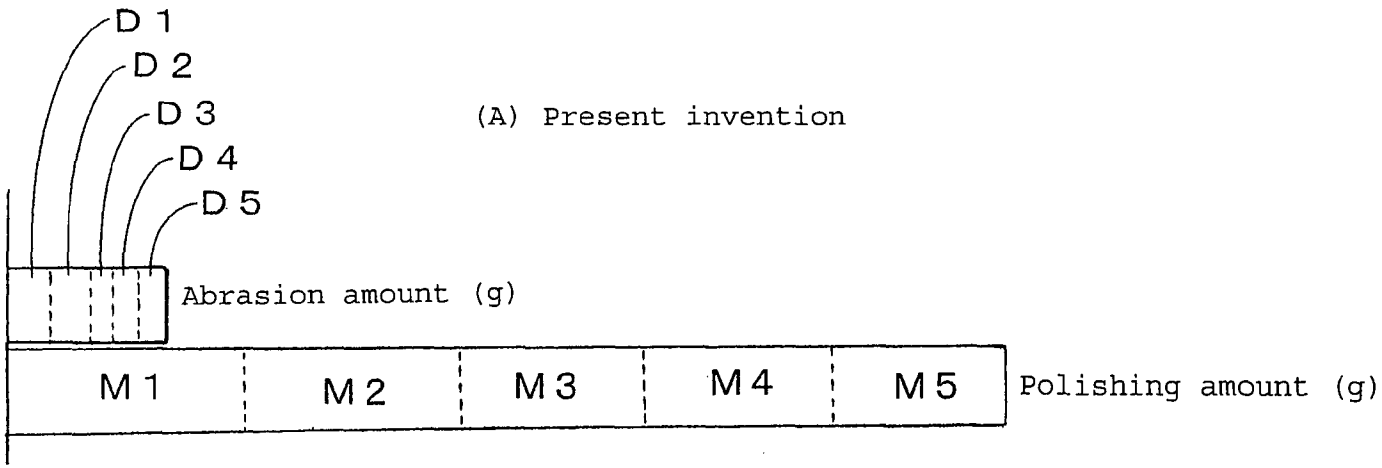
FIG. 6A shows the case using a revolving whetstone of the present invention.

FIG. 6A shows the results of the present invention, and as for the whetstone body, the amount D1 was abraded by polishing for first five minutes, and the amount D2 was abraded for next five minutes, and the amount D3 was abraded for the next five minutes, and the amount D4 was abraded for the next five minutes, and the amount D5 was abraded for the next five minutes respectively, and the entire abrasion amount was approximately 47.8 mm. On the other hand, as for the workpiece, the amount M1 was polished for the first five minutes of the polishing work, and the amount M2 was polished for the next five minutes of the polishing work, and the amount M3 was polished for the next five minutes of the polishing work, and the amount M4 was polished for the next five minutes of the polishing work, and the amount M5 was polished for the next five minutes of the polishing work respectively, and the entire polishing amount was approximately 299 mm, and even with the same diameter as the whetstone diameter 100 mm of the conventional example, the residual amount diameter of the whetstone that carried out the polishing work for five times every five minutes was left 96 mm, and the mass of 36 mm was left to 60 mm that is 40% of the effective use amount 100 mm, and this operation rate of the residual amount was equivalent to 2.5 times, and it has been found that 2.5 times of economic efficiency can be obtained in comparison with the whetstone of the conventional example.

Figure 6B:
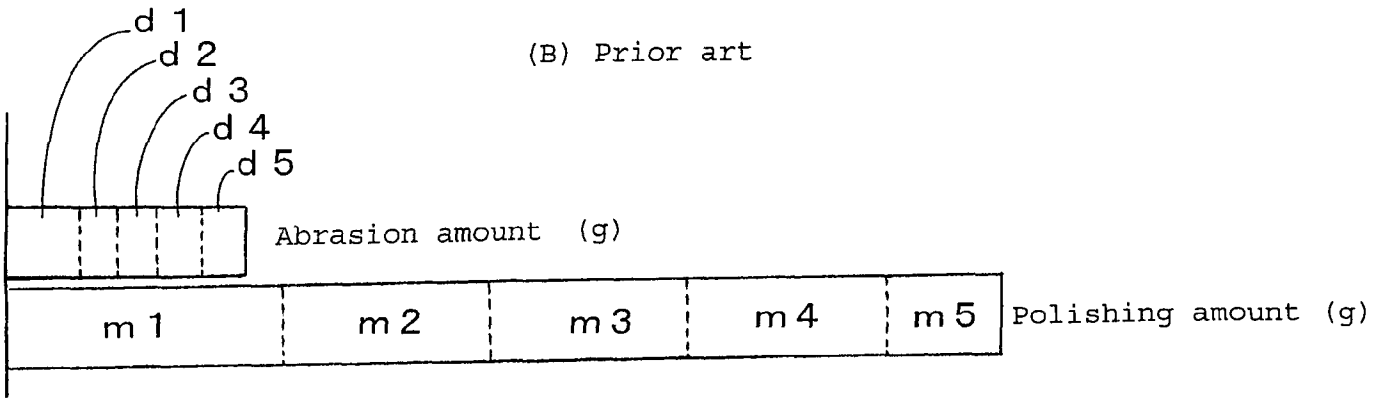
FIG. 6B shows the case using a conventional revolving whetstone.

FIG. 6B shows the conventional case, and as for the whetstone body, the amount d1 was abraded for the first five minutes of the polishing work, and the amount d2 was abraded for the next five minutes, and the amount d3 was abraded for the next five minutes, and the amount d4 was abraded for the next five minutes, and the amount d5 was abraded for the next five minutes respectively, and the entire abrasion was approximately 68.0 mm. On the other hand, as for the workpiece, the amount m1 was polished for the first five minutes of the polishing work, the amount m2 was polished for the next five minutes of the polishing work, the amount m3 was polished for the next five minutes of the polishing work, the amount m4 was polished for the next five minutes of the polishing work, and the amount m5 was polished for the next five minutes of the polishing work respectively, and the entire polishing amount was approximately 309.3 mm As can be seen from the above experiment results, it has been found that even when the same amount of a workpiece to be polished is polished, in the revolving whetstone 11 of the present embodiment, the abrasion amount of the whetstone main body 12 is smaller than that of the conventional revolving whetstone, and even if a revolving whetstone of the same external diameter is formed with the same amount of the whetstone material as that of the conventional whetstone used for molding a revolving whetstone, the life time of the revolving whetstone of the present embodiment becomes longer than that of the conventional revolving whetstone, and in addition, the operation efficiency becomes larger. Therefore, it is possible to reduce the number of exchange work times, and improve the economic efficiency. Furthermore, the amount of the whetstone material that constitutes the central portion to be disposed is smaller than that of the conventional structure, and accordingly, the amount of the whetstone material to be disposed becomes small, and the preferable effect to the environment is attained.

Figure 7:
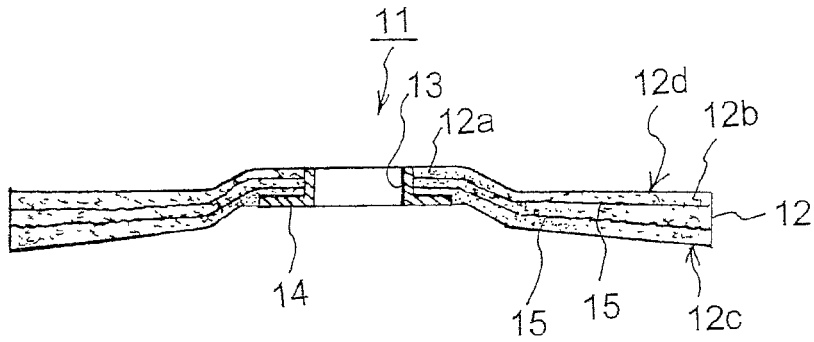
FIG. 7 is a cross sectional view a modified example of a revolving whetstone to which the present invention is applied.
Figure 8:
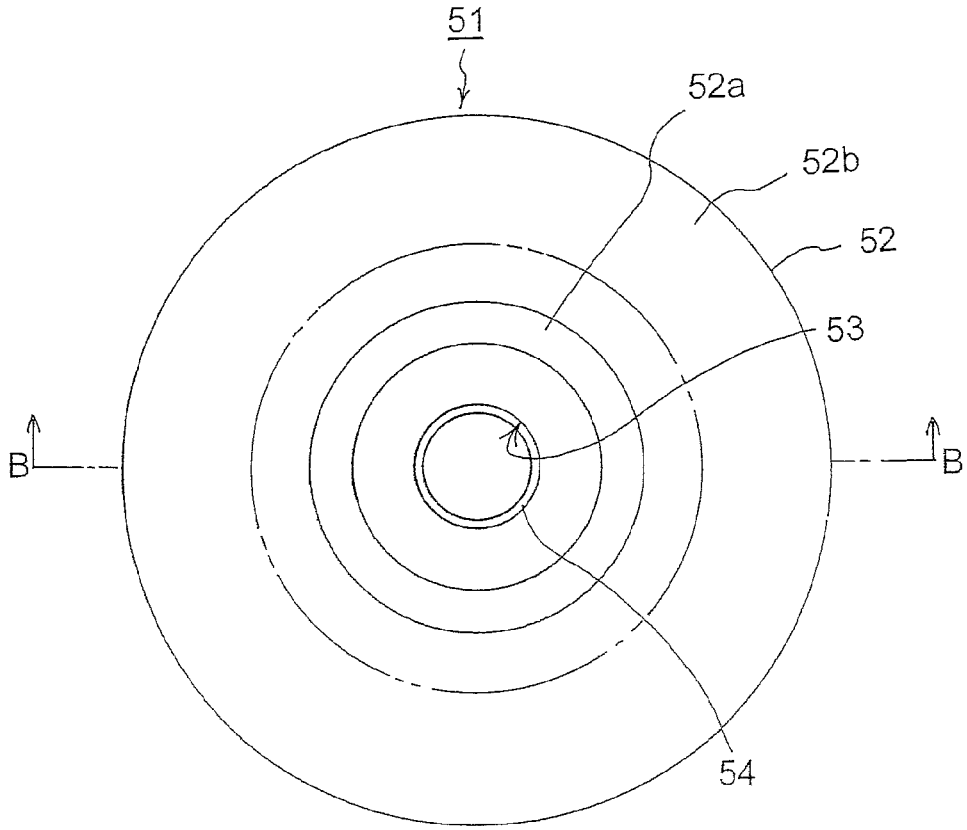
FIG.8 (PRIOR ART)
FIG. 8 is a top view showing a conventional revolving whetstone.
Figure 9:
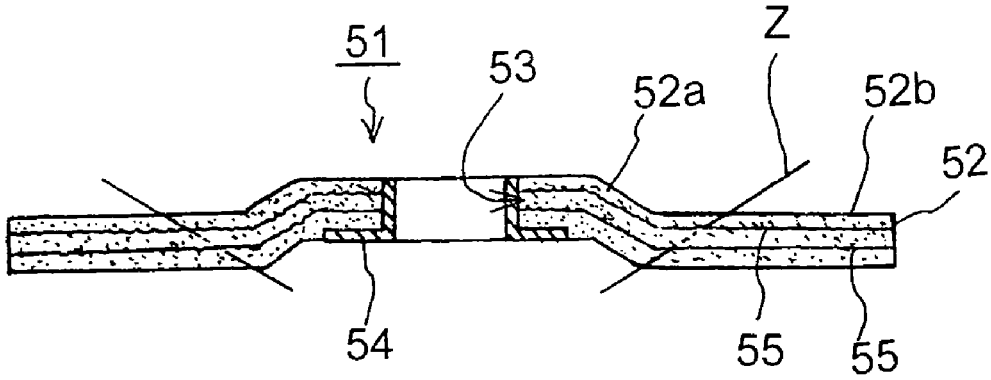
FIG. 9 is a cross sectional view taken along B-B line of FIG. 8.
Figure 10:
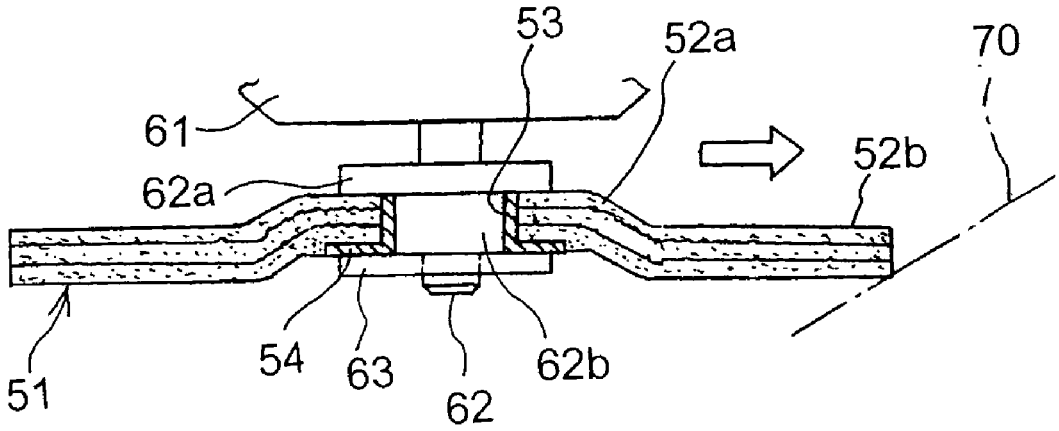
FIG. 10 is an explanatory figure of the use conditions of a conventional revolving whetstone.

In addition, in the structure of the embodiment, the revolving whetstone 11 in which the surplus whetstone material generated by thinning the wall thickness of the central portion 12*a* is put on the surface 12*d* of the opposite side of one surface 12*c* facing the workpiece to be polished 40 is disclosed, however, the revolving whetstone 11 may be formed, for example, as shown in FIG. 7, by putting the surplus whetstone material on the one surface 12*c* facing the workpiece to be polished 40 so that the thickness increases gradually from the rotation central side to the outer side. In this case, the same effects as those in the revolving whetstone 11 shown in FIG. 1 to FIG. 3 can be also obtained.

Further, as several modified forms may be embodied in the present invention without departing from the spirit thereof, such modified embodiment are therefore intended to be embraced in the present invention.

What is claimed is:

1. A method of manufacturing a revolving whetstone comprising with a central portion in which a whetstone center hole into which a whetstone driving shaft of a grinder is inserted is arranged and a disk-shaped whetstone body that has an effective whetstone circular portion arranged in the circumferential outside of the central portion as one body, wherein the wall thickness of the central portion is formed thinner than the wall thickness of the effective whetstone circular portion, and a whetstone material for the thinned wall thickness of the central portion is put on the wall thickness surface of the effective whetstone circular portion, and the wall thickness of the effective whetstone circular portion is formed thicker than the wall thickness of the central portion.

2. A revolving whetstone to be manufactured by the method of manufacturing a revolving whetstone according to claim 1, the revolving whetstone comprising a central portion in which a whetstone center hole into which a whetstone driving shaft of a grinder is inserted is arranged and a disk-shaped whetstone body that has an effective whetstone circular portion arranged in the circumferential outside of the central portion as one body, wherein the wall thickness of the effective whetstone circular portion is formed thicker than the wall thickness of the central portion.

3. The revolving whetstone according to claim 2, wherein a whetstone material for the thinned wall thickness of the central portion is put on the surface side of the opposite side of one side facing a workpiece to be polished of the effective whetstone circular portion, so that the thickness increases gradually from the rotation central side to the outer side.

4. The revolving whetstone according to claim 2, wherein a whetstone material for the thinned wall thickness of the central portion is put on one surface side facing a workpiece to be polished of the effective whetstone circular portion, so that the thickness increases gradually from the rotation central side to the outer side.

5. A method of manufacturing a revolving whetstone comprising the steps of:

forming a whetstone having an inner central portion with a first wall thickness and an effective outer circular portion having a second wall thickness;

reducing the first wall thickness of the inner central portion creating surplus whetstone material;

placing the surplus whetstone material on the effective outer circular portion increasing the second wall thickness, and wherein the second wall thickness of the effective outer circular portion is greater than the first wall thickness of the inner central portion, whereby surplus whetstone material generated by making the inner central portion thinner is put on the effective outer circular portion making the effective outer circular portion thicker.

6. A method of manufacturing a revolving whetstone as in claim 5 wherein:

said step of placing the surplus whetstone material comprises placing the surplus whetstone material so that the second wall thickness increase from the inner central portion to an end of the effective outer circular portion.

7. A revolving whetstone manufactured in accordance with the method of claim 5.

* * * * *